US010788215B2

(12) United States Patent
Bailey et al.

(10) Patent No.: US 10,788,215 B2
(45) Date of Patent: Sep. 29, 2020

(54) FUEL NOZZLE ASSEMBLY WITH FLANGE ORIFICE

(71) Applicant: General Electric Company, Schenectady, NY (US)

(72) Inventors: Donald Mark Bailey, Simpsonville, SC (US); Lucas John Stoia, Taylors, SC (US)

(73) Assignee: General Electric Company, Schenectady, NY (US)

( * ) Notice: Subject to any disclaimer, the term of this patent is extended or adjusted under 35 U.S.C. 154(b) by 811 days.

(21) Appl. No.: 15/386,190

(22) Filed: Dec. 21, 2016

(65) Prior Publication Data

US 2018/0172276 A1 Jun. 21, 2018

(51) Int. Cl.
*F23R 3/28* (2006.01)
*F23R 3/60* (2006.01)
*F23D 14/62* (2006.01)

(52) U.S. Cl.
CPC ..... *F23R 3/286* (2013.01); *F23D 14/62* (2013.01); *F23R 3/283* (2013.01); *F23R 3/60* (2013.01); *F05D 2240/35* (2013.01)

(58) Field of Classification Search
CPC .. F23R 3/283; F23R 3/286; F23R 3/60; F23R 2900/00012; F23R 2900/00017; F23R 3/28; F23D 14/48; F23D 14/62; F02C 7/22; F02C 7/222; F05D 2240/35
See application file for complete search history.

(56) References Cited

U.S. PATENT DOCUMENTS

| | | | | |
|---|---|---|---|---|
| 7,134,287 | B2 * | 11/2006 | Belsom | F23R 3/60 60/800 |
| 7,841,180 | B2 * | 11/2010 | Kraemer | F02C 7/22 60/39.822 |
| 8,438,851 | B1 * | 5/2013 | Uhm | F23R 3/04 60/737 |
| 8,528,334 | B2 * | 9/2013 | Dutta | F23R 3/343 431/268 |
| 8,820,086 | B2 * | 9/2014 | Bailey | F23K 5/14 60/734 |
| 9,033,699 | B2 * | 5/2015 | Stoia | F23R 3/286 431/144 |
| 9,140,455 | B2 * | 9/2015 | Stoia | F23R 3/286 |
| 9,188,340 | B2 * | 11/2015 | Bailey | F23R 3/10 |
| 9,347,668 | B2 * | 5/2016 | Westmoreland | F23R 3/286 |
| 9,366,439 | B2 * | 6/2016 | Melton | F23R 3/10 |
| 2005/0005610 | A1 * | 1/2005 | Belsom | F23R 3/60 60/796 |
| 2007/0151255 | A1 * | 7/2007 | Johnson | F23D 14/48 60/776 |

(Continued)

*Primary Examiner* — Alain Chau
(74) *Attorney, Agent, or Firm* — Dority & Manning, P.A.

(57) ABSTRACT

A fuel nozzle assembly includes a flange body. The flange body includes a base portion that defines an aperture. The flange body is connected to a conduit. The flange body and the conduit define a fuel flow passage to a fuel plenum of the fuel nozzle assembly. The fuel nozzle assembly further includes an insert that is partially disposed within the aperture of the base portion. The insert includes an orifice disposed within the aperture of the base portion and a forward portion of the insert extends axially outwardly from the aperture. The orifice is in fluid communication with the fuel flow passage.

19 Claims, 6 Drawing Sheets

(56) References Cited

U.S. PATENT DOCUMENTS

| | | | | |
|---|---|---|---|---|
| 2008/0110172 | A9* | 5/2008 | Bruck | F23R 3/40 60/723 |
| 2009/0320483 | A1 | 12/2009 | Storey et al. | |
| 2010/0089065 | A1* | 4/2010 | Tuthill | F23D 11/106 60/737 |
| 2012/0048961 | A1 | 3/2012 | Singh et al. | |
| 2012/0180488 | A1* | 7/2012 | Bailey | F23K 5/14 60/739 |
| 2012/0183911 | A1* | 7/2012 | Belsom | F23R 3/283 431/144 |
| 2012/0272660 | A1* | 11/2012 | Garrett | F23R 3/002 60/796 |
| 2013/0122438 | A1* | 5/2013 | Stoia | F23R 3/286 431/144 |
| 2013/0125548 | A1* | 5/2013 | Dutta | F23R 3/40 60/723 |
| 2013/0125549 | A1* | 5/2013 | Bailey | F23R 3/10 60/737 |
| 2014/0096526 | A1* | 4/2014 | Marquez | F23N 1/007 60/734 |
| 2014/0260267 | A1* | 9/2014 | Melton | F23R 3/10 60/737 |
| 2014/0260276 | A1* | 9/2014 | Westmoreland | F23R 3/286 60/746 |
| 2015/0308345 | A1 | 10/2015 | Holzman et al. | |
| 2016/0003479 | A1* | 1/2016 | Woods | F23R 3/283 29/890.01 |

* cited by examiner

FUEL NOZZLE ASSEMBLY WITH FLANGE ORIFICE

FIELD OF THE TECHNOLOGY

The present invention generally involves a combustor for a gas turbine. More specifically, the invention relates to a fuel nozzle assembly including an orifice disposed within a flange body of the fuel nozzle assembly.

BACKGROUND

During operation of a gas turbine engine, pressurized air from a compressor flows into a head end volume defined within the combustor. The pressurized air flows from the head end volume into an inlet to a corresponding premix passage of a respective fuel nozzle assembly. Fuel is injected into the flow of pressurized air within the premix passage where it mixes with the pressurized air so as to provide a fuel and air mixture to a combustion zone or chamber defined downstream from the fuel nozzle. The fuel and air mixture is burned in the combustion chamber to produce hot combustion gases.

The fuel may be supplied to the fuel nozzle(s) via one or more fuel circuits defined within an endcover which is fluidly coupled to a fuel supply. A pre-orifice insert or insert body is installed or seated within a respective fuel circuit of the endcover upstream from the fuel nozzle to meter the fuel flowing to the fuel nozzle. One drawback with placing the pre-orifice inserts strictly in the endcover is that it is necessary to flow test a complete endcover including the fuel nozzle assembly in order to test the flow therethrough and to create a flow matched set of complete endcover assemblies for a given gas turbine.

BRIEF DESCRIPTION OF THE TECHNOLOGY

Aspects and advantages are set forth below in the following description, or may be obvious from the description, or may be learned through practice.

One embodiment of the present disclosure is directed to a fuel nozzle assembly. The fuel nozzle assembly includes a flange body. The flange body includes a base portion that defines an aperture. The flange body is connected to a conduit. The flange body and the conduit define a fuel flow passage to a fuel plenum of the fuel nozzle assembly. The fuel nozzle assembly further includes an insert that is partially disposed within the aperture of the base portion. The insert includes an orifice disposed within the aperture of the base portion and a forward portion of the insert extends axially outwardly from the aperture. The orifice is in fluid communication with the fuel flow passage.

One embodiment of the present disclosure is directed to a combustor. The combustor includes an endcover defining a fuel circuit and a first fuel circuit outlet and a fuel nozzle assembly. The fuel nozzle assembly includes a plurality of nozzle segments which is annularly arranged about a center fuel nozzle. The plurality of nozzle segments includes a first nozzle segment. The first nozzle segment includes a flange body including a base portion which defines an aperture. The base portion is connected to the endcover and the flange body is connected to a conduit. The flange body and the conduit define a fuel flow passage to a fuel plenum of the first nozzle segment. The fuel nozzle assembly further includes an insert that is partially disposed within the aperture of the base portion of the flange body. The insert includes an orifice that is disposed within the aperture of the base portion and a forward portion of the insert extends axially outwardly from the aperture and into the first fuel circuit outlet. The orifice is in fluid communication with the fuel flow passage and provides for fluid communication from the first fuel circuit outlet to the fuel plenum of the first nozzle segment.

Another embodiment of the present disclosure is directed to a combustor. The combustor includes an endcover defining a fuel circuit and a first fuel circuit outlet and a fuel nozzle assembly. The fuel nozzle assembly includes a plurality of nozzle segments which is annularly arranged about a center fuel nozzle. The center fuel nozzle includes a flange body including a base portion which defines an aperture. The base portion is connected to the endcover and the flange body is connected to a conduit. The flange body and the conduit define a fuel flow passage to a fuel plenum of the center fuel nozzle. The fuel nozzle assembly further includes an insert that is partially disposed within the aperture of the base portion of the flange body. The insert includes an orifice that is disposed within the aperture of the base portion and a forward portion of the insert extends axially outwardly from the aperture and into the first fuel circuit outlet. The orifice is in fluid communication with the fuel flow passage and provides for fluid communication from the first fuel circuit outlet to the fuel plenum of the center fuel nozzle.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode thereof to one skilled in the art, is set forth more particularly in the remainder of the specification, including reference to the accompanying figures, in which.

DETAILED DESCRIPTION

Figure 1:
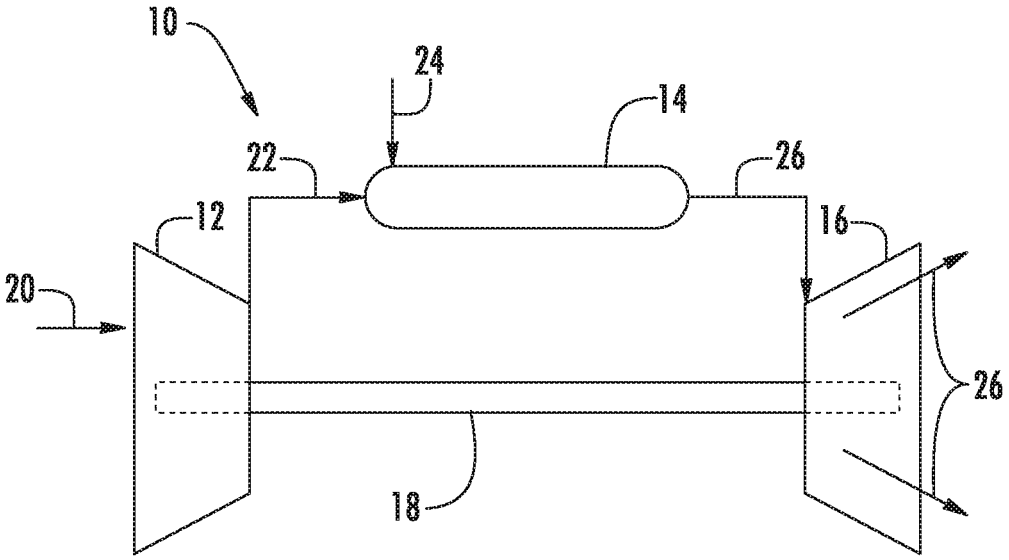
FIG. 1 is a functional block diagram of an exemplary gas turbine that may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a combustor for a land based power generating gas turbine for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited in the claims.

Referring now to the drawings, FIG. 1 illustrates a schematic diagram of an exemplary gas turbine 10. The gas turbine 10 generally includes a compressor 12, at least one combustor 14 disposed downstream of the compressor 12 and a turbine 16 disposed downstream of the combustor 14. Additionally, the gas turbine 10 may include one or more shafts 18 that couple the compressor 12 to the turbine 16.

During operation, air 20 flows into the compressor 12 where the air 20 is progressively compressed, thus providing compressed or pressurized air 22 to the combustor 14. At least a portion of the compressed air 22 is mixed with a fuel 24 within the combustor 14 and burned to produce combustion gases 26. The combustion gases 26 flow from the combustor 14 into the turbine 16, wherein energy (kinetic and/or thermal) is transferred from the combustion gases 26 to rotor blades (not shown), thus causing shaft 18 to rotate. The mechanical rotational energy may then be used for various purposes such as to power the compressor 12 and/or to generate electricity. The combustion gases 26 may then be exhausted from the gas turbine 10.

Figure 2:
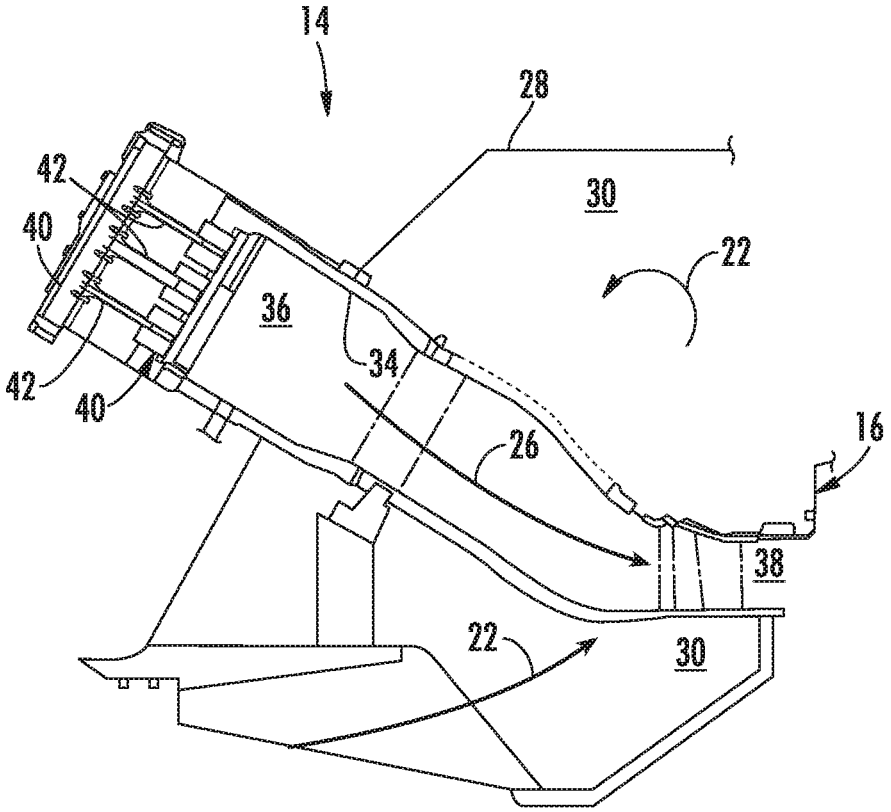
FIG. 2 is a simplified cross-section side view of an exemplary combustor as may incorporate various embodiments of the present disclosure.

As shown in FIG. 2, the combustor 14 may be at least partially surrounded by an outer casing 28 such as a compressor discharge casing. The outer casing 28 may at least partially define a high pressure plenum 30 that at least partially surrounds various components of the combustor 14. The high pressure plenum 30 may be in fluid communication with the compressor 12 (FIG. 1) so as to receive the compressed air 22 therefrom. An endcover 32 may be coupled to the outer casing 28. One or more combustion liners or ducts 34 may at least partially define a combustion chamber or zone 36 for combusting the fuel-air mixture and/or may at least partially define a hot gas path through the combustor 14 for directing the combustion gases 26 towards an inlet 38 to the turbine 16. In various embodiments, as shown in FIG. 2, the combustor 14 includes a fuel nozzle assembly 40.

Figure 3:
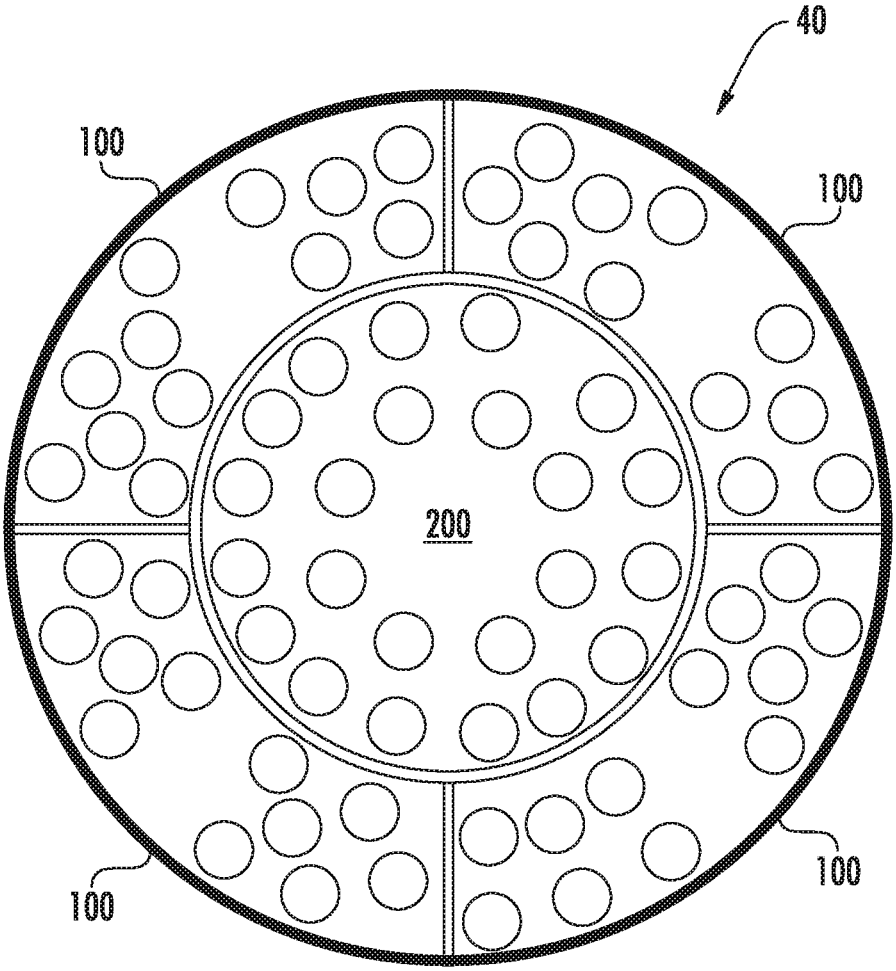
FIG. 3 is an upstream view of an exemplary fuel nozzle assembly according to at least one embodiment of the present disclosure.

FIG. 3 provides an upstream view of an exemplary fuel nozzle assembly 40 according to at least one embodiment of the present disclosure. In particular embodiments, as shown in FIG. 3, the fuel nozzle assembly 40 includes a plurality of nozzle segments 100 annularly arranged about a fuel nozzle or primary fuel nozzle 200. Although FIG. 3 illustrates four individual nozzle segments 100, the combustor 14 may include two or more nozzle segments 100 and is not limited to four nozzles segments 100 unless otherwise recited in the claims. In other embodiments, fuel nozzle assembly 40 may include just a single fuel nozzle 200.

Figure 4:
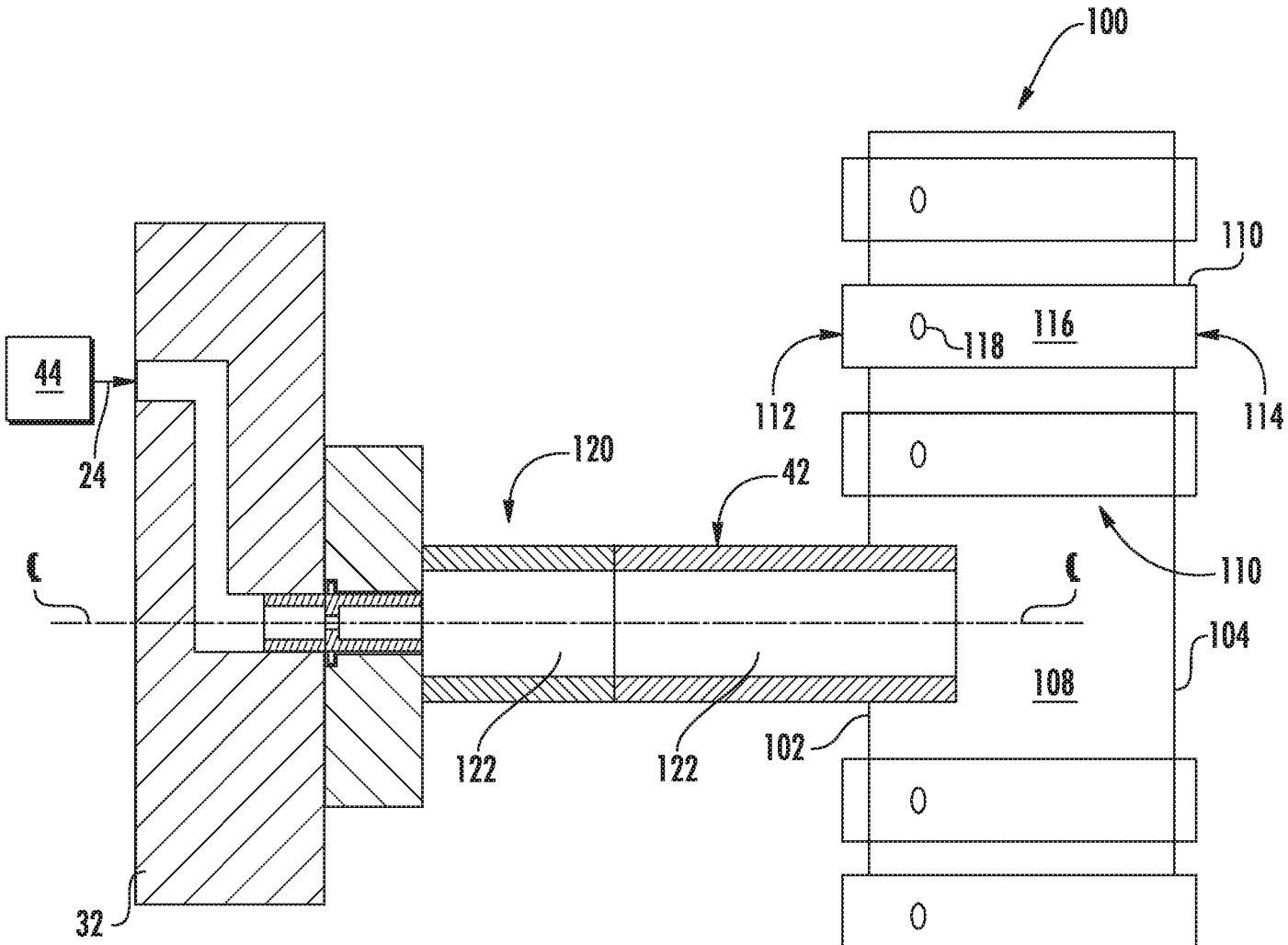
FIG. 4 is a cross-sectioned perspective view of an exemplary nozzle segment of the fuel nozzle assembly as shown in FIG. 3, according to at least one embodiment of the present disclosure.

FIG. 4 provides a cross-sectioned perspective view of an exemplary nozzle segment 100 according to at least one embodiment of the present disclosure. In particular embodiments, as shown in FIG. 4, the nozzle segment 100 includes a first plate 102, a second plate 104 axially spaced from the first plate 102, and an outer band or sleeve 106 that extends axially between the first plate 102 and the second plate 104. A fuel plenum 108 is defined between the first plate 102, the second plate 104 and the outer band 106. A plurality of premix tubes 110 extends through the first plate 102, the fuel plenum 108 and the second plate 104. Each premix tube 110 includes an inlet 112, an outlet 114 and a premix flow passage 116 defined therebetween. The respective inlet 112 to one or more of the premix tubes 110 is in fluid communication with the high pressure plenum 30 (FIG. 2). One or more of the premix tubes 110 may include at least one fuel port 118 disposed within and in fluid communication with the fuel plenum 108.

In particular embodiments, as shown in FIG. 4, the nozzle segment 100 may be connected to the endcover 32 via a flange body 120. A conduit or conduit assembly 42 extends from the flange body 120 to the first plate 102 of the nozzle segment 100. The flange body 120 and/or the conduit 42 define(s) a fuel flow passage 122 between the endcover 32 and/or a fuel supply 44 and the fuel plenum 108.

Figure 5:
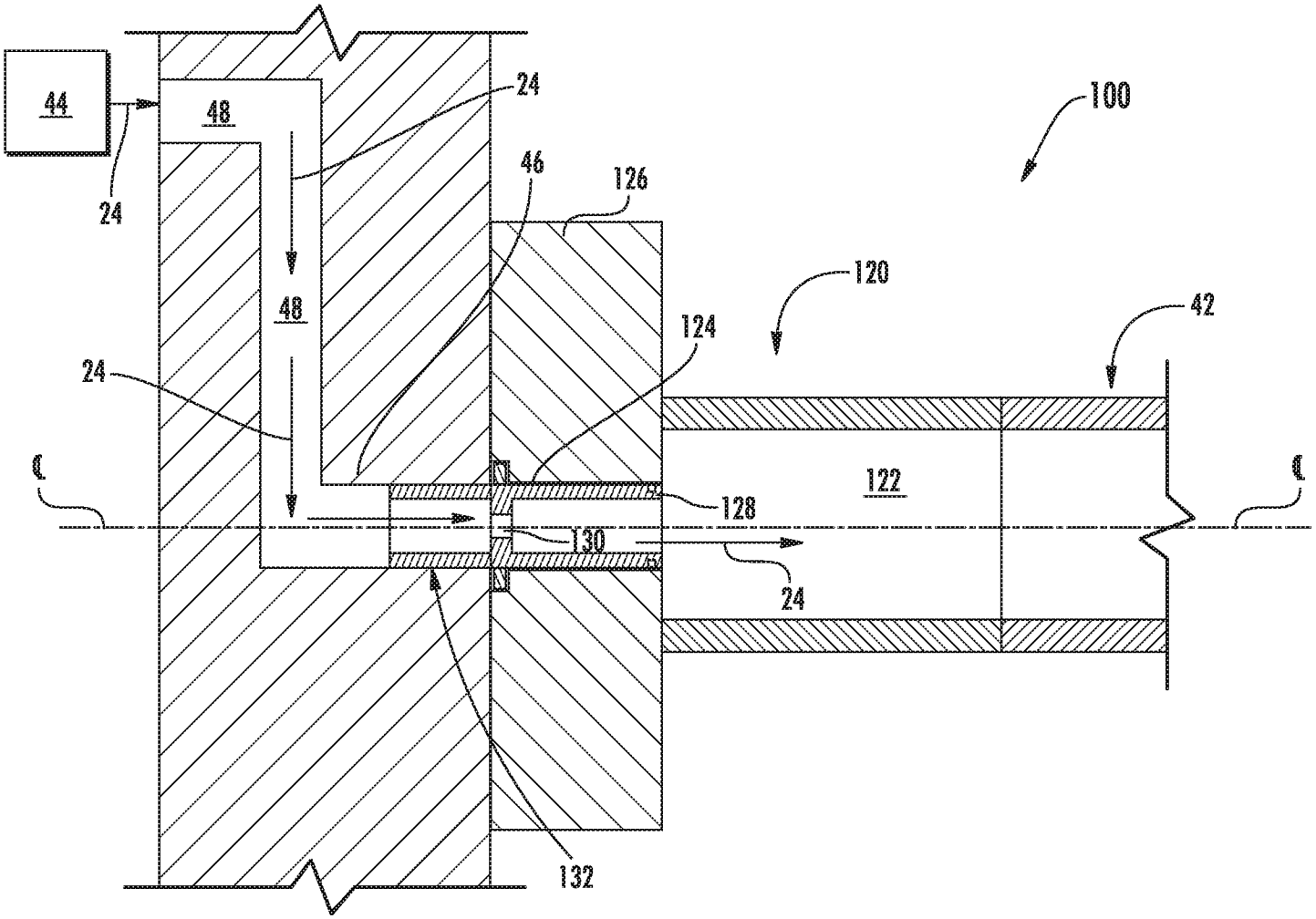
FIG. 5 is an enlarged cross-sectional side view of a portion of the nozzle segment shown in FIG. 4, according to at least one embodiment of the present disclosure.

FIG. 5 provides an enlarged cross-sectional side view of a portion of the nozzle segment 100 shown in FIG. 4, according to at least one embodiment of the present disclosure. In various embodiments, as shown in FIG. 5, the flange body 120 defines an aperture 124 in a base portion 126 of the flange body 120. The aperture 124 is aligned with a corresponding fuel circuit outlet or hole 46 at least partially defined within and/or by the endcover 32. The fuel circuit outlet 46 is in fluid communication with a fuel circuit 48 at least partially defined within and/or by the endcover 32. The fuel circuit 48 is fluidly coupled to the fuel supply 44.

In various embodiments, an insert 128 is disposed or seated within the aperture 124. In particular embodiments, the insert 128 is aligned or coaxially aligned with the fuel flow passage 122. The insert 128 defines and/or includes an orifice 130 defined downstream from the fuel circuit outlet 46 and positioned within the base portion 126 of the flange body 120. The orifice 130 provides for fluid communication from the fuel circuit 48 to the fuel passage 122. In particular embodiments, a forward or upstream portion 132 of the insert 128 extends axially into the fuel circuit outlet 46. In this manner, the forward portion 132 of the insert 128 forms a thermal shield between the flange body 120, particularly the base portion 126, and relatively cold fuel flowing through the insert 128 during operation, thereby reducing the potential for displacement of the insert 128 during thermal transients of the combustor 14.

Figure 6:
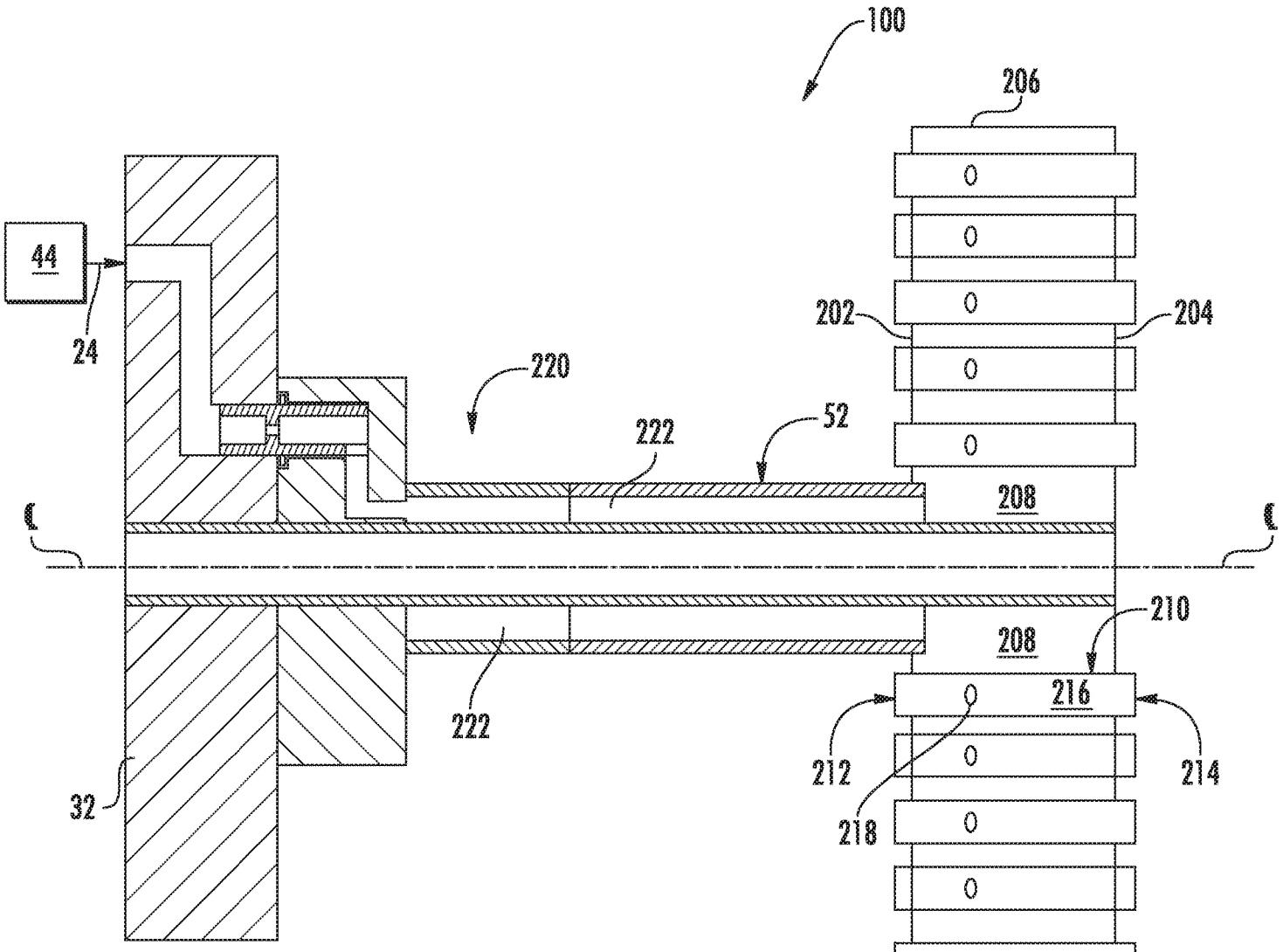
FIG. 6 is a cross-sectioned perspective view of an exemplary center or primary fuel nozzle of the fuel nozzle assembly as shown in FIG. 3, according to at least one embodiment of the present disclosure.

FIG. 6 provides a cross-sectioned perspective view of an exemplary primary fuel nozzle 200 according to at least one embodiment of the present disclosure. In particular embodiments, as shown in FIG. 6, the primary fuel nozzle 200 includes a first plate 202, a second plate 204 axially spaced from the first plate 202, and an outer band or sleeve 206 that extends axially between the first plate 202 and the second plate 204. A fuel plenum 208 is defined between the first plate 202, the second plate 204 and the outer band 206. A plurality of premix tubes 210 extends through the first plate 202, the fuel plenum 208 and the second plate 204. Each premix tube 210 includes an inlet 212, an outlet 214 and a premix flow passage 216 defined therebetween. The respective inlet 212 to one or more of the premix tubes 210 is in fluid communication with the high pressure plenum 30 (FIG. 2). One or more of the premix tubes 210 may include at least one fuel port 218 disposed within and in fluid communication with the fuel plenum 208.

In particular embodiments, as shown in FIG. 6, the primary fuel nozzle 200 may be connected to the endcover 32 via a flange body 220. A conduit or conduit assembly 52 extends from the flange body 220 to the first plate 202 of the primary fuel nozzle 200. The flange body 220 and/or the conduit 52 define(s) a fuel flow passage 222 between the endcover 32 and/or the fuel supply 44 and the fuel plenum 208.

Figure 7:
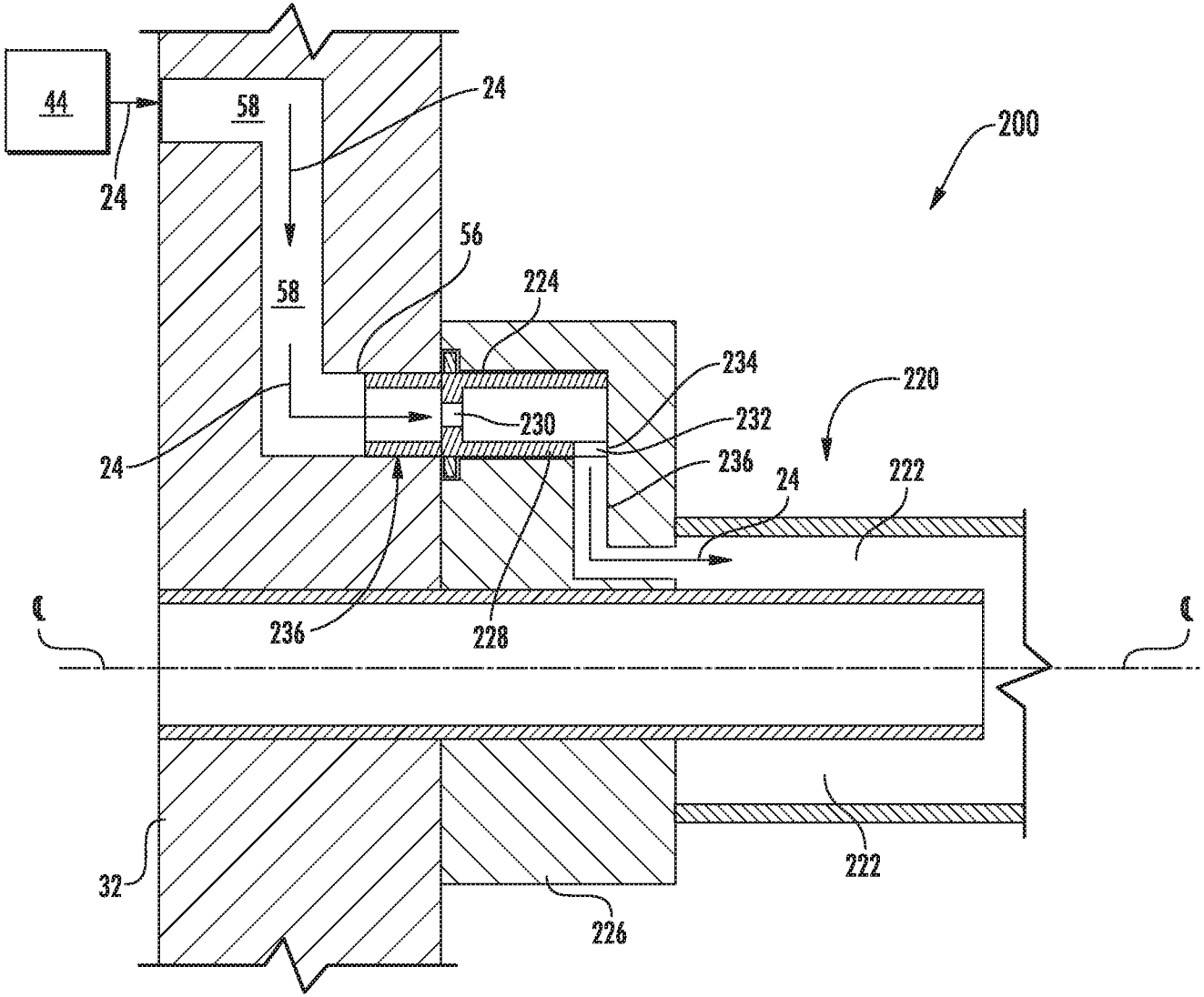
FIG. 7 is an enlarged cross-sectional side view of a portion of the nozzle segment shown in FIG. 6, according to at least one embodiment of the present disclosure.

FIG. 7 provides an enlarged cross-sectional side view of a portion of the primary fuel nozzle 200 shown in FIG. 6, according to at least one embodiment of the present disclosure. In various embodiments, as shown in FIG. 7, the flange body 220 defines an aperture 224 in a base portion 226 of the flange body 220. The aperture 224 is aligned with a corresponding fuel circuit outlet or hole 56 at least partially defined within and/or by the endcover 32. The fuel circuit outlet 56 is in fluid communication with a fuel circuit 58 at least partially defined within and/or by the endcover 32. The fuel circuit 58 is fluidly coupled to the fuel supply 44.

In various embodiments, an insert 228 is disposed or seated within the aperture 224. In particular embodiments, the insert 228 is radially offset from a centerline of the conduit 52 and/or the fuel flow passage 222. The insert 228 defines and/or includes a first orifice 230 defined downstream from the fuel circuit outlet 56 and positioned within the base portion 226 of the flange body 220. In particular embodiments, the insert 228 may include a second orifice 232 defined downstream from the first orifice 230. In particular embodiments, the second orifice 232 may be defined along a side wall 234 of the insert 228.

The flange body 220 may further define a flow passage 236 downstream from the insert 228 and upstream from the fuel passage 222. The first orifice 230 and the second orifice 232 when present, provide for fluid communication from the fuel circuit 58 to the flow passage 235 and/or the fuel passage 222. In particular embodiments, a forward or upstream portion 236 of the insert 228 extends axially into the fuel circuit outlet 56. In this manner, the forward portion 236 of the insert 228 forms a thermal shield between the flange body 220, particularly the base portion 226, and relatively cold fuel flowing through the insert 228 during operation, thereby reducing the potential for displacement of the insert 228 during thermal transients of the combustor 14.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor, comprising:

an endcover defining a fuel circuit and a first fuel circuit outlet;

a fuel nozzle assembly, comprising:

a flange body including a base portion defining an aperture, wherein the base portion is connected to the endcover and wherein the flange body is connected to an upstream end of a conduit, wherein the flange body and the conduit define a fuel flow passage to a fuel plenum of the fuel nozzle assembly, the fuel plenum connected to a downstream end of the conduit; and an insert seated within the aperture of the base portion, wherein the insert is coaxially aligned with the first fuel circuit outlet, wherein the insert includes an orifice disposed within the aperture of the base portion, wherein a forward portion of the insert extends axially outwardly from the aperture and into the first fuel circuit outlet, wherein the forward portion of the insert includes an outer surface that extends parallel to the first fuel circuit outlet along an entire axial length of the forward portion, and wherein the orifice is in fluid communication with the fuel flow passage, the orifice providing a reduced cross-sectional flow area through a portion of the insert for metering a fuel flow therethrough.

2. The combustor as in claim 1, wherein the insert is coaxially aligned with the conduit.

3. The combustor as in claim 1, wherein the insert is radially offset from the conduit with respect to an axial centerline of the conduit.

4. The combustor as in claim 1, wherein the fuel plenum is defined between a first plate, a second plate and an outer band of the fuel nozzle assembly.

5. The combustor as in claim 4, further comprising a plurality of premix tubes that extends through the first plate, the fuel plenum and the second plate, wherein one or more premix tubes of the plurality of premix tubes is in fluid communication with the fuel plenum.

6. A combustor, comprising:

an endcover defining a fuel circuit and a first fuel circuit outlet;

a fuel nozzle assembly including a plurality of nozzle segments annularly arranged about a center fuel nozzle, wherein the plurality of nozzle segments includes a first nozzle segment, the first nozzle segment comprising:

a first flange body including a first base portion defining a first aperture, wherein the first base portion is connected to the endcover and wherein the first flange body is connected to an upstream end of a first conduit, wherein the first flange body and the first conduit define a first fuel flow passage to a fuel plenum of the first nozzle segment, the fuel plenum connected to a downstream end of the first conduit; and a first insert seated within the first aperture of the first base portion, wherein the first insert is coaxially aligned with the first fuel circuit outlet, wherein the first insert includes a first orifice disposed within the first aperture of the first base portion, wherein a forward portion of the first insert extends axially outwardly from the first aperture and into the first fuel circuit outlet, wherein the forward portion of the insert includes an outer surface that extends parallel to the first fuel circuit outlet along an entire axial length of the forward portion, and wherein the first orifice is in fluid communication with the first fuel flow passage and provides for fluid communication from the first fuel circuit outlet to the fuel plenum of the first nozzle segment, the first orifice providing a reduced cross-sectional flow area through a portion of the first insert for metering a fuel flow therethrough.

7. The combustor as in claim 6, wherein the first insert is coaxially aligned with the first conduit of the first nozzle segment.

8. The combustor as in claim 6, wherein the fuel plenum of the first nozzle segment is defined between a first plate, a second plate and an outer band of the first nozzle segment.

9. The combustor as in claim 8, further comprising a plurality of premix tubes that extends through the first plate, the fuel plenum and the second plate of the first nozzle segment, wherein one or more premix tubes of the plurality of premix tubes is in fluid communication with the fuel plenum.

10. The combustor as in claim 6, wherein the center fuel nozzle comprises a second flange body including a second base portion defining a second aperture, wherein the second base portion is connected to the endcover and wherein the second flange body is connected to a second conduit, wherein the second flange body and the second conduit define a second fuel flow passage to a fuel plenum of the center fuel nozzle.

11. The combustor as in claim 10, wherein the center fuel nozzle further comprises a second insert partially disposed within the second aperture of the second base portion, wherein the second insert includes a second orifice disposed within the second aperture of the second base portion and a forward portion of the second insert extends axially outwardly from the second aperture and into a second fuel circuit outlet of the endcover, wherein the second orifice is in fluid communication with the second fuel flow passage of the center fuel nozzle.

12. The combustor as in claim 11, wherein the second insert is radially offset from the second conduit with respect to an axial centerline of the second conduit.

13. A combustor, comprising:

an endcover defining a fuel circuit and a first fuel circuit outlet;

a fuel nozzle assembly including a plurality of nozzle segments annularly arranged about a center fuel nozzle, wherein the center fuel nozzle comprises:

a first flange body including a first base portion defining a first aperture, wherein the first base portion is connected to the endcover and wherein the first flange body is connected to an upstream end of a first conduit, wherein the first flange body and the first conduit define a first fuel flow passage to a fuel plenum of the center fuel nozzle, wherein the fuel plenum is connected to a downstream end of the first conduit; and a first insert seated within the first aperture of the first base portion, wherein the first insert is coaxially aligned with the first fuel circuit outlet, wherein the first insert includes a first orifice disposed within the first aperture of the first base portion, wherein a forward portion of the first insert extends axially outwardly from the first aperture and into the first fuel circuit outlet, wherein the forward portion of the first insert includes an outer surface that is entirely in contact with the first fuel circuit outlet along an axial direction, and wherein the first orifice is in fluid communication with the first fuel flow passage and provides for fluid communication from the first fuel circuit outlet to the fuel plenum of the center fuel nozzle, the first orifice providing a reduced cross-sectional flow area through a portion of the first insert for metering a fuel flow therethrough.

14. The combustor as in claim 13, wherein the first insert is radially offset from the first conduit with respect to an axial centerline of the first conduit.

15. The combustor as in claim 13, wherein the fuel plenum of the center fuel nozzle is defined between a first plate, a second plate and an outer band of the center fuel nozzle.

16. The combustor as in claim 15, further comprising a plurality of premix tubes that extends through the first plate, the fuel plenum and the second plate of the center fuel nozzle, wherein one or more premix tubes of the plurality of premix tubes is in fluid communication with the fuel plenum.

17. The combustor as in claim 13, wherein the plurality of nozzle segments comprises a first nozzle segment, the first nozzle segment comprising:

a second flange body including a second base portion defining a second aperture, wherein the second base portion is connected to the endcover and wherein the second flange body is connected to a second conduit, wherein the second flange body and the second conduit define a second fuel flow passage to a fuel plenum of the first nozzle segment; and a second insert partially disposed within the second aperture of the second base portion, wherein the second insert includes a second orifice disposed within the second aperture of the second base portion and a forward portion of the second insert extends axially outwardly from the second aperture and into a second fuel circuit outlet of the endcover, wherein the second orifice is in fluid communication with the second fuel flow passage.

18. The combustor as in claim 17, wherein the second insert is coaxially aligned with the second conduit of the first nozzle segment.

19. The combustor as in claim 17, wherein the first nozzle segment further comprises a plurality of premix tubes that extends through a first plate, the fuel plenum and a second plate of the first nozzle segment, wherein one or more premix tubes of the plurality of premix tubes is in fluid communication with the fuel plenum of the first nozzle segment.

* * * * *